US008672154B2

(12) United States Patent
Seelhofer

(10) Patent No.: US 8,672,154 B2
(45) Date of Patent: Mar. 18, 2014

(54) FILLABLE CLOSURE DEVICE WITH TRIGGERING PUSHBUTTON

(75) Inventor: Fritz Seelhofer, Lindau (CH)

(73) Assignees: Belcap Switzerland AG, Neuhausen am Rheinfall (CH); RIWISA AG, Hägglingen (CH)

( * ) Notice: Subject to any disclaimer, the term of this patent is extended or adjusted under 35 U.S.C. 154(b) by 506 days.

(21) Appl. No.: 12/808,851

(22) PCT Filed: Jan. 19, 2009

(86) PCT No.: PCT/CH2009/000019

§ 371 (c)(1),
(2), (4) Date: Jun. 17, 2010

(87) PCT Pub. No.: WO2009/100544

PCT Pub. Date: Aug. 20, 2009

(65) Prior Publication Data

US 2010/0288767 A1 Nov. 18, 2010

(30) Foreign Application Priority Data

Feb. 14, 2008 (CH) ..... 210/08
Jan. 19, 2009 (WO) ..... PCT/CH2009/000019

(51) Int. Cl.
*B65D 51/22* (2006.01)
*B65D 25/08* (2006.01)

(52) U.S. Cl.
USPC ..... 215/227; 206/222; 222/80; 222/82; 222/81

(58) Field of Classification Search
USPC ..... 215/227, 255, 228, 250, 253, 247, 50, 215/246, 321, 328, 330, 331, 335, 336; 220/552
See application file for complete search history.

(56) References Cited

U.S. PATENT DOCUMENTS 973,397 A * 10/1910 Wilzin ..... 215/253
3,456,369 A * 7/1969 Leposky ..... 37/232
5,141,133 A * 8/1992 Ninomiya et al. ..... 222/83
5,853,109 A * 12/1998 Elliott ..... 222/83
5,979,164 A * 11/1999 Scudder et al. ..... 62/4

* cited by examiner

*Primary Examiner* — Anthony Stashick
*Assistant Examiner* — Kevin Castillo
(74) *Attorney, Agent, or Firm* — CUSPA Technology Law Associates; Yi Li

(57) ABSTRACT

The fillable closure with a triggering pushbutton comprises a filler neck (3) that is to be screwed onto or joined to a container neck (4) as well as a closure cap (1) which is associated to the filler neck (3) and can be joined, pivoted and snapped-on the filler neck (3) by means of a hinge connection. A separately fillable container (2) can be inserted into the filler neck (3), the container being closed at the bottom with a sealing foil (19) that can be pierced or cut open. The closure cap (1) comprises a cap cover as a pusher disc (7), which can be pressed downward in the axial direction while deforming. By pressing the cap cover downward on the container (2) inserted in the filler neck or on a rigid opening element accommodated therein, the opening element can be pressed downward so that the sealing foil (19) of the container (2) can be pierced and cut open.

12 Claims, 8 Drawing Sheets

FILLABLE CLOSURE DEVICE WITH TRIGGERING PUSHBUTTON

Figure 1:
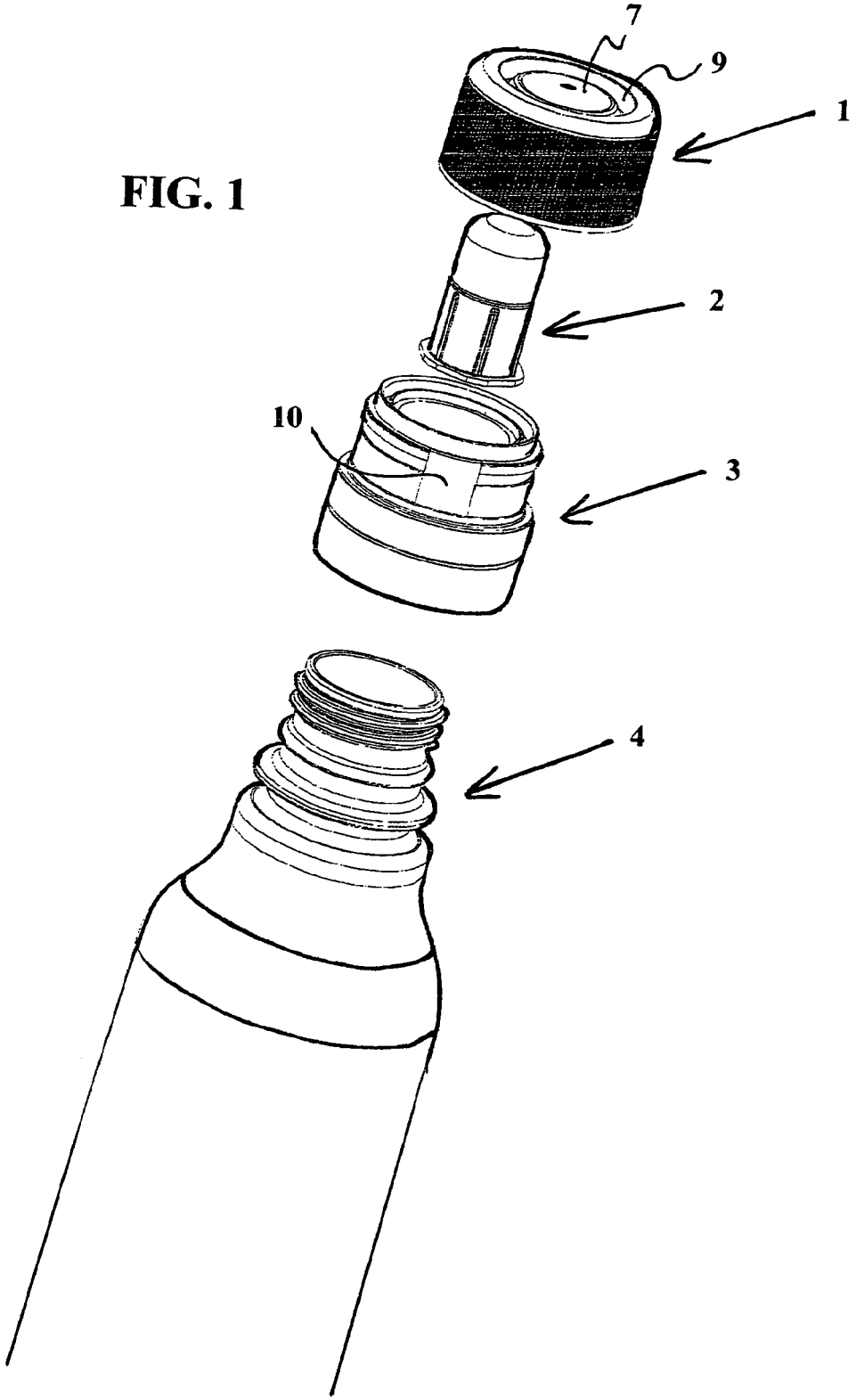

This invention relates to a fillable closure device that can be triggered using a pushbutton, thereby opening the small, separately filled container accommodated in the interior of the closure device and emptying it into the container equipped with the closure device. Many beverages are created these days by mixing a concentrate with water. Instead of distributing the final mixture, it would be much more efficient if bottlers could simply bottle water locally, and the concentrate would be added to the water in the bottle by consumers when they open the bottle for the first time, thereby mixing the concentrate with the water.

A known solution for the metered addition of a separate fluid is a plastic dosing closure device and an associated container neck for a container. It is composed of a threaded cap, a separately fillable capsule that can be closed using foil, is closed after filling, and is disposed inside the threaded cap, and an associated container neck. The capsule, including its sealing foil, is retained upside down inside the container neck. The cap, which is placed on the container neck, extends into the interior of the container neck, and a piercing and cutting device is provided on the lower edge of the container neck and is used to open the sealing foil on the lower end of the capsule the first time the plastic dosing closure device is opened, thereby enabling the substance contained in the capsule to drop into the container. When rotated in the counterclockwise direction, i.e. in the loosening direction, the threaded cap is initially pushed downward onto the container neck, thereby pressing the foil of the capsule over a piercing and cutting device and cutting it while the threaded cap on the container neck hits a stop. If the threaded cap is rotated further in the loosening direction, it carries the container neck along with it, the container neck being seated on the container connector via a thread but requiring greater torque to be unscrewed. Therefore, when the threaded cap is rotated further, it carries the container neck and the capsule, which is contained therein and is now empty, along with it, and the entire closure device is unscrewed from the container connector. The elegance of this solution is that it requires a single handling step, namely simply continuing to unscrew the threaded cap in the loosening direction. All steps are automatically carried out in proper order. The disadvantage of this solution, however, is that it is elaborate in terms of design and implementation, requiring both left-handed threads and right-handed threads, and assembling the closure device is likewise problematic.

The object of the present invention is to create a fillable closure device for a capsule to be filled separately, which is easier to manufacture and assemble, while accepting the fact that it cannot be actuated using a single handling step.

This object is solved by a fillable closure device having a triggering pushbutton, comprising a connector to be screwed or pressed onto a container neck, and a closure cap associated with this connector and that can be screwed on, or swiveled downward and snapped into place, wherein a separately fillable container can be inserted into the connector and is closed at the bottom using a sealing foil that can be pierced or cut open, characterized in that the closure cap includes a cap cover which can be pressed downward in the axial direction while deforming; as the cap cover is pressed downward, the capsule inserted in the connector, or a stiff opening element accommodated therein, can be pressed downward, thereby enabling the sealing foil of the separately fillable container to be pierced and cut open.

Various variants of this fillable closure device with pushbutton are presented in a plurality of views in the figures. The closure device will be described in detail and its function will be explained with reference to these figures.

Figure 3:
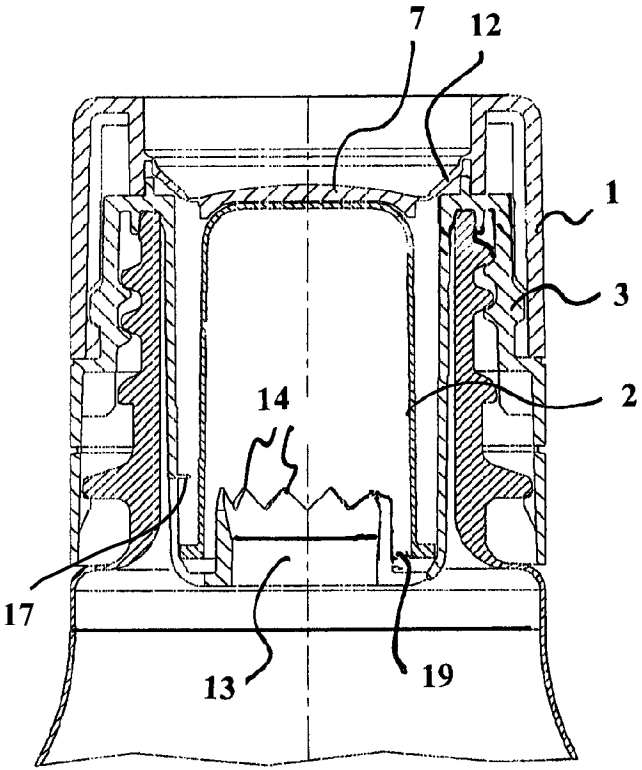
Figure 2:
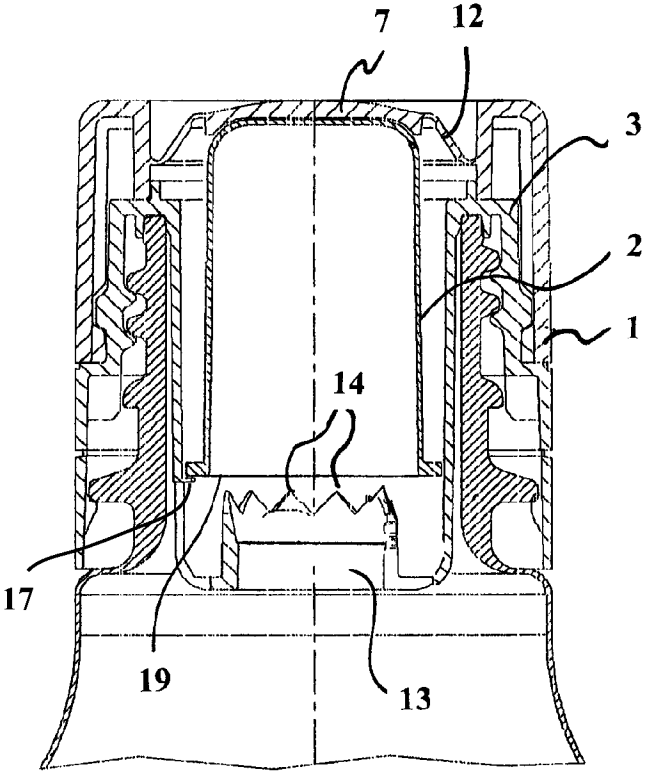
Figure 4:
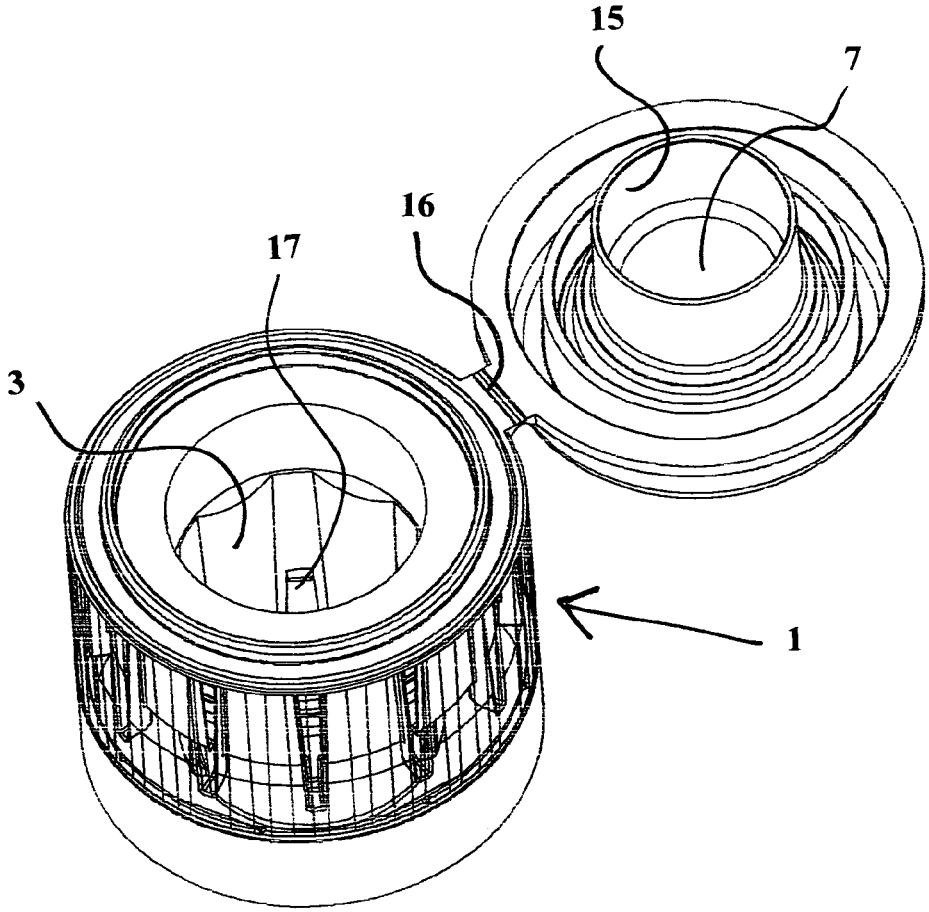
Figure 5:
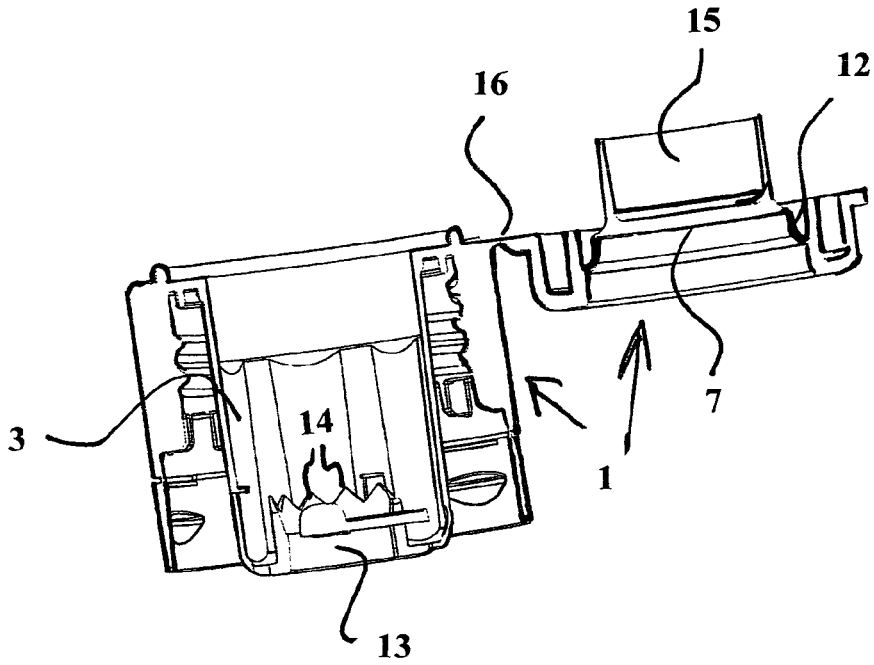
Figure 6:
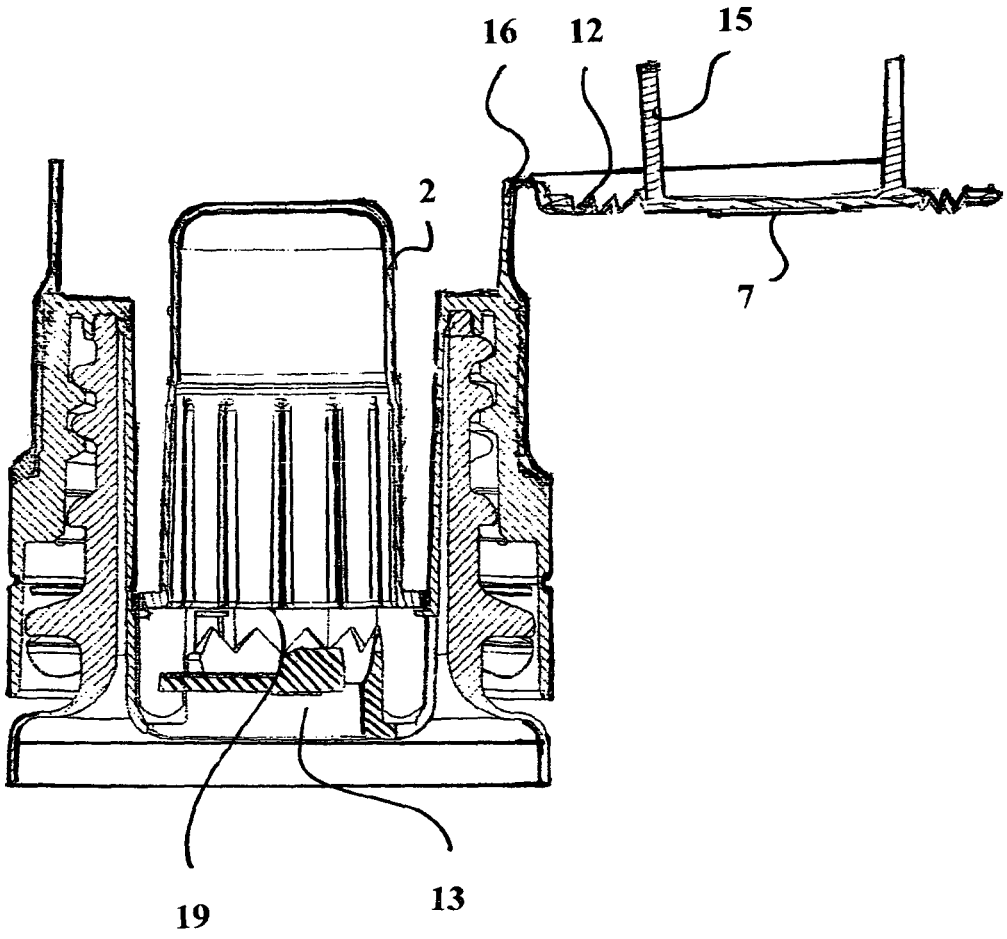
Figure 7:
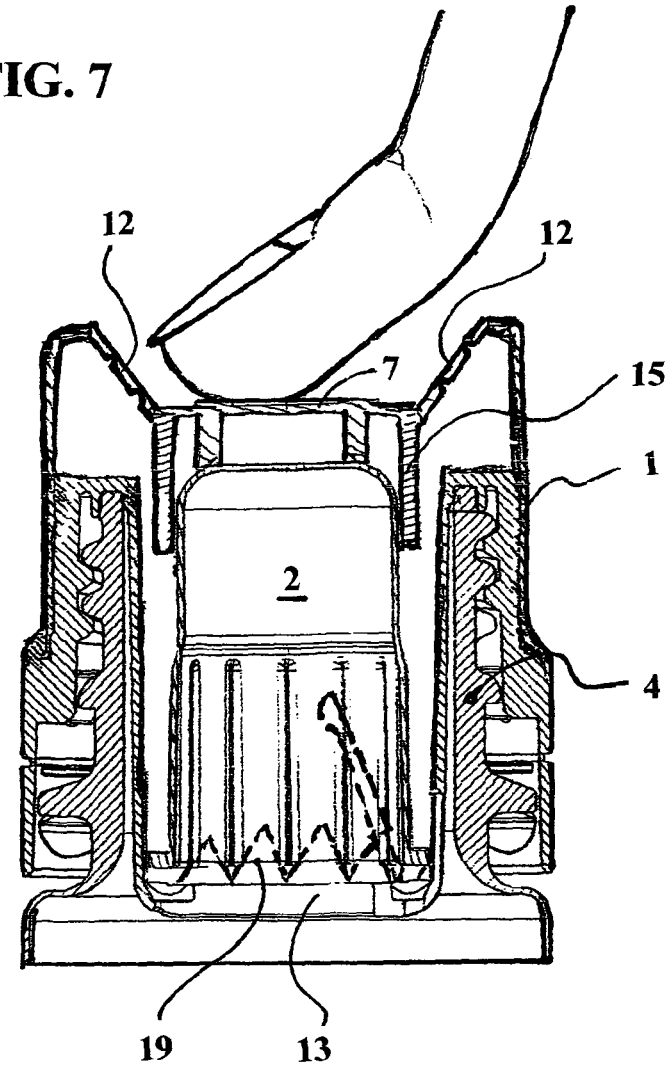
Figure 8:
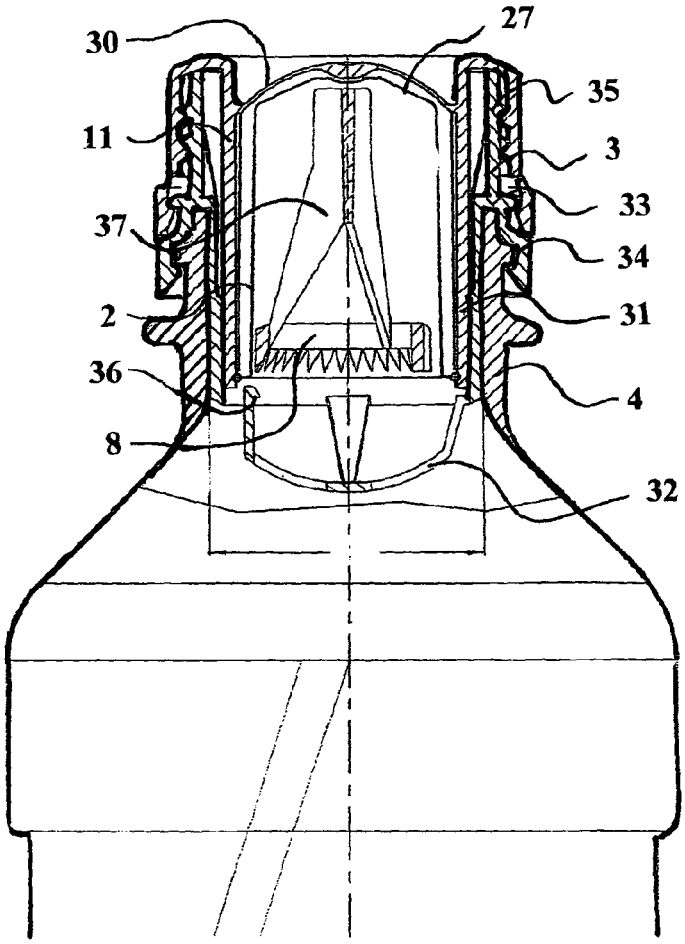
Figure 9:
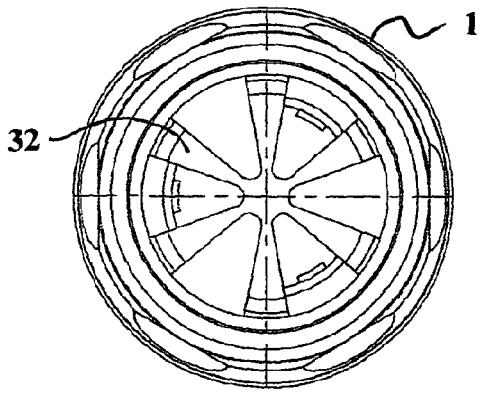
Figure 10:
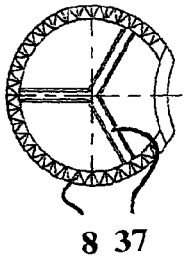
Figure 11:
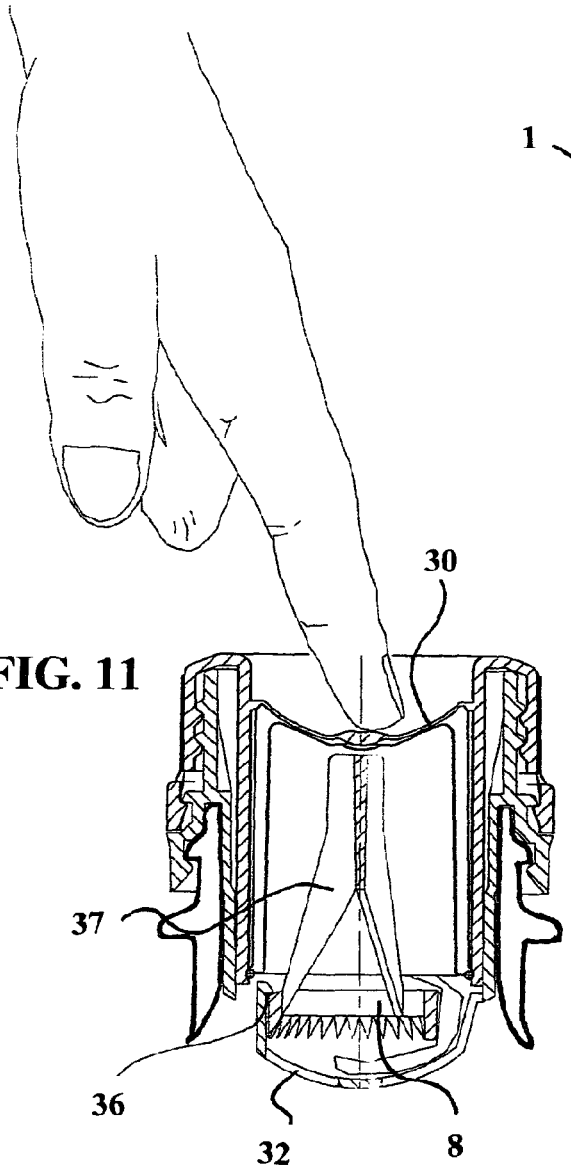
Figure 12:
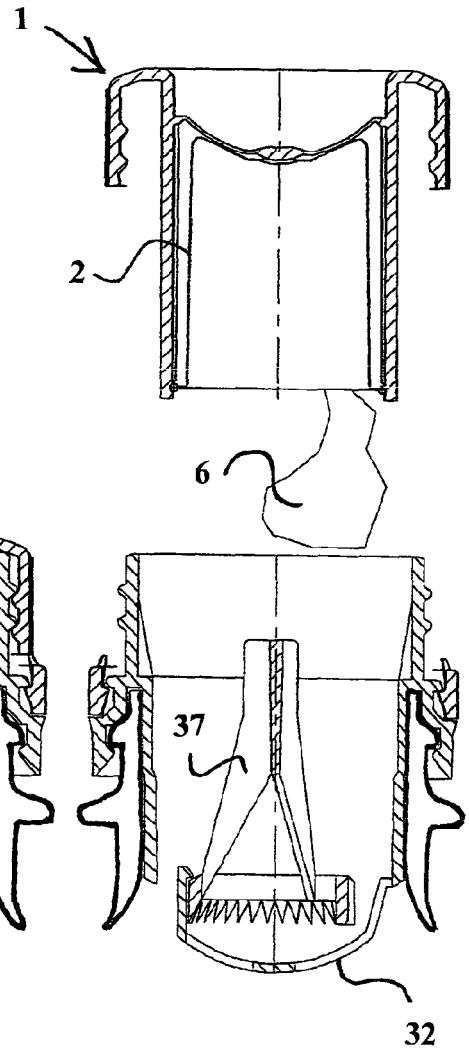

They show:

FIG. 1 The individual parts of a fillable closure device with pushbutton in the disassembled state, shown on a common axis, including closure cap to be pressed on;

FIG. 2 This closure device in a sectional view along the rotational axis, in the closed starting position, and the container which is disposed therein and contains a separate substance;

FIG. 3 This closure device in a sectional view along the rotational axis, after the container which is disposed therein and contains a separate substance has been opened;

FIG. 4 A fillable closure device including the closure cap hingedly connected to the connector, in the swiveled-open state, without the separate container located therein;

FIG. 5 The closure cap with the pusher disc in the cap cover, and the receiving sleeve integrally formed at the bottom, in a sectional view;

FIG. 6 The closure cap according to FIG. 5 in the state in which it is swiveled away from the connector, with the separately filled container inserted therein, in a sectional view;

FIG. 7 The instant in which the closure device of the foil-sealed container, which contains a separate substance and is inserted in the closure device, is opened, before the closure cap is swiveled away from the connector;

FIG. 8 A fillable closure device for triggering the addition of the substance via the forcing-through of an opening mechanism inside the container;

FIG. 9 The plastic dosing closure according to FIG. 8, as viewed from below;

FIG. 10 The piercing and cutting mechanism that belongs to the plastic dosing closure according to FIG. 8, as viewed from below;

FIG. 11 The plastic dosing closure according to FIG. 8, upon triggering the addition of the substance;

FIG. 12 The plastic dosing closure according to FIG. 8, after the closure cap was removed.

FIG. 1 shows the individual parts of a fillable closure device with pushbutton, in the disassembled state. Shown at the top is closure cap 1 which can be pressed onto connector 3. Connector 3 can be screwed onto container neck 4 of the container which is a bottle in this case. A separate small container 2 can be inserted into connector 3; container 2 contains a separate substance that should drop into the container or bottle situated underneath when the closure device is opened for the first time. A pusher disc 7, which is used as a pushbutton, is disposed at the top on closure cap 1, is enclosed by a deformable annulus 9, and is connected by annulus 9 to the outer wall of closure cap 1. Fillable container 2 is closed at the bottom by a sealing foil and can be inserted entirely into connector 3. Connector 3 is screwed onto container neck 4 of the bottle. On its outer side, connector 3 has a flat region 10 where ribs that are integrally formed on the inside of closure cap 1 come to rest. When closure cap 1 is pressed onto connector 3, these ribs prevent rotation from occurring relative to connector 3. That is, when closure cap 1 is rotated forcefully, it carries connector 3 along, thereby unscrewing it from container neck 4. Before the entire closure device is unscrewed from container neck 4 in this manner, however, the substance should first drop out of separate small container 2 into the bottle. To accomplish this, pusher disc 7 is pressed downward from the top. Therefore, to open this closure device: Press down on the top—then rotate.

FIG. 2 shows the closure device in a sectional view along the rotational axis, in the closed starting position. As shown, small, separately filled container 2 is accommodated in the interior of connector 3. Pusher disc 7 lies squarely on the top side of small container 2. Pusher disc 7 is connected to the outer wall of closure cap 1 at the edge via a deformable region 12. A piercing and cutting device 13 is disposed underneath, in the connector, and includes upwardly extending teeth 14.

FIG. 3 shows the situation after pusher disc 7 has been pressed downward. Deformable region 12 around pusher disc 7 was swiveled downward, and pusher disc 7 pushed container 2 in connector 3 axially downward, thereby pushing sealing foil 19 of container 2 over teeth 14 of piercing and cutting device 13 and tearing it open. As a result, the substance fell out of container 2 and dropped into the bottle. Closure cap 1 can now be rotated in the loosening direction, thereby unscrewing it, along with connector 3, from container neck 4.

FIG. 4 shows an embodiment of the fillable closure device including the closure cap cover, which is hingedly connected via hinge 16, in the state in which the closure cap is swiveled open, and without the separate container inside. On the bottom of the closure cap, a receiving sleeve 15 is integrally formed on pusher disc 7 in the closure cap. Receiving sleeve 15 fits exactly over the top part of the container to be inserted and which contains the separate substance to be added. A holding element 17 that is used to captively hold small container 2 to be inserted is shown inside connector 3 (also see FIGS. 2 and 3).

FIG. 5 shows the variant in which closure cap 1 according to FIG. 4 is hingedly connected to the connector via a hinge 16. A receiving sleeve 15 is integrally formed on the underside of pusher disc 7 in the same manner. Piercing and cutting device 13 including teeth 14 is shown at the bottom in connector 3. The receiving sleeve always ensures that, when the pusher disc is pressed downward, it is moved exactly in the axial direction and does not tilt since receiving sleeve 15 with container 2 disposed therein is inevitably guided axially. Receiving sleeve 15 therefore stabilizes pusher disc 7 when it is pressed down.

FIG. 6 shows a cross section of the closure cap according to FIG. 5, in the state in which it is swiveled away from connector 3 and with foil-sealed container 2 inserted, container 2 containing a separate substance. The cap cover is connected to the connector via hinge 16. Container 2, which contains the separate substance, is disposed inside the closure device, with sealing foil 19 directed toward teeth 14 of piercing and cutting device 13. The cap cover encloses a pusher disc 7 which is enclosed and held by a bellows-type, deformable edge 12. Receiving sleeve 15 is integrally formed at the bottom on pusher disc 7; when the cap cover is swiveled shut, receiving sleeve 15 comes to rest with an exact fit on the top region of container 2, thereby enclosing it.

FIG. 7 shows pusher disc 7 being pressed down. Receiving sleeve 15 encloses the upper region of small container 2, which contains the separate substance, and ensures that container 2 is pressed downward axially over piercing and cutting device 13. Bellows-type, deformable regions 12 become extended when pusher disc 7 is pushed downward.

FIG. 8 shows another embodiment of a plastic dosing closure device. A threaded sleeve 3 is placed on container neck 4, which forms a smooth sleeve 31 at the bottom that fits squarely into the interior of container neck 4 and includes a collecting grid 32 that is integrally formed on its lower edge and extends into the interior of the sleeve. On the upper edge of smooth sleeve 31, the latter forms a radially outwardly extending bridge 33 and, on its outer edge, a downwardly directed apron 34 that is used to press threaded sleeve 3 onto container neck 4, and so apron 34 encloses container neck 4 outwardly in a sealing manner. Disposed on bridge 33 is a coaxially upwardly extending sleeve 35 having an external thread with a right-handed thread. A threaded cap 1 can be screwed onto sleeve 35 in the clockwise direction from above. Threaded cap 1 includes, on its underside, a connector 11 that can be slid into smooth sleeve 31, into the interior of which a downwardly open capsule 2 is inserted, capsule 2 being closed by a film 6 and including an elastic capsule base 27 that bulges upwardly in the manner of a dome. Capsule 2 is snapped or clamped into place. Cap 1 also includes an elastic cap base 30 that bulges upwardly in the manner of a dome, and so finger pressure can be applied to cap base 30 from the outside, thereby deforming cap base 30 and enabling a stiff piercing and cutting element 8 having a pressing stem 37 inside the capsule to be pressed downward, thereby piercing and cutting sealing foil 6 of capsule 2. Collecting grid 32, which is integrally formed at the bottom on smooth sleeve 31 of threaded sleeve 3, prevents piercing and cutting element 8 from dropping into the container. Piercing and cutting element 8 hooks into barb 36 on collecting grid 32 and is thereby secured against falling out. As soon as the contents of the capsule have been emptied into the container in this manner, cap 1, including connector 11 and capsule 2 contained therein, is screwed off of threaded sleeve 3, and the container is ready to be poured.

FIG. 9 shows cap 1 from below, including star-shaped collecting grid 32, while FIG. 10 shows piercing and cutting element 8 in a view from below. Central pressing stem 37 is connected in a star-shaped manner to the ring, on which the piercing and cutting teeth are integrally formed. FIG. 11 illustrates the use of the cap, namely opening capsule 2 located therein by pressing down on domed bulge 30 in the center of the cap cover. The ring of piercing and cutting element 8 hooks into barb 36 on the collecting grid. FIG. 12 shows the situation after cap 1 has been removed, including capsule 2 which is contained therein and is now empty. Foil piece 6 that has been cut out extends downward from opened capsule 2, and piercing and cutting element 8 is henceforth retained on collecting grid 32.

The invention claimed is:

1. A fillable closure device with a triggering pushbutton, comprising:

(a) a connector (3) to be placed on a container neck (4), said connector (3) comprising a smooth sleeve (31) at a lower portion thereof, fitting into an interior of the container neck 4, and a collecting grid (32) integrally formed at a bottom of the smooth sleeve (31) underneath an interior of the smooth sleeve;

(b) a separate container (2) inserted into the connector (3) and positioned above the collecting grid (32), the separate container (2) having a closed deformable top, an open bottom sealed by a sealing foil (6) that can be pierced or cut open, and a separate stiff piercing and cutting element (8) disposed inside the separate container above the sealing foil (6); and (c) a cap (1) removably attached to an upper portion of the connector (3), the cap (1) comprising a deformable cap cover (30) able to be pressed downward in an axial direction, the cap cover situated above the separate container (2), wherein when the cap cover is pressed downward onto the deformable top of the separate container (2), the stiff piercing and cutting element (8) inside the separate container (2) is pressed downward against the sealing foil (6), thereby causing the sealing foil (6) to be pierced and cut open.

2. The fillable closure device with triggering pushbutton according to claim 1, wherein the collecting grid (32) collects the separate piercing and cutting element (8) dropped from the separate container, when the sealing foil (6) is cut open.

3. The fillable closure device with triggering pushbutton according to claim 1, wherein the collecting grid (32) has a star-shaped structure.

4. The fillable closure device with triggering pushbutton according to claim 1, wherein the deformable top of the separate container (2) bulges upwardly in the manner of a dome.

5. The fillable closure device with triggering pushbutton according to claim 1, wherein the stiff piercing and cutting element (8) has a ring with downwardly directed piercing and cutting teeth and a pressing stem (37) extending upward from the ring.

6. The fillable closure device with triggering pushbutton according to claim 5, wherein the pressing stem (37) is connected in a star-shaped manner to the ring.

7. The fillable closure device with triggering pushbutton according to claim 1, wherein the separate container (2) is snapped or clamped into place.

8. The fillable closure device with triggering pushbutton according to claim 1, wherein the deformable cap cover (30) of cap (1) is in a form of upward dome.

9. The fillable closure device with triggering pushbutton according to claim 1, wherein the cap (1) has a downwardly extended connector (11) that is slid into the smooth sleeve (31) of the connector (3), and the separate container (2) is inserted into an interior of the downwardly extended connector (11).

10. The fillable closure device with triggering pushbutton according to claim 1, wherein the connector (3) is in a form of threaded sleeve placed on container neck 4.

11. The fillable closure device with triggering pushbutton according to claim 1, wherein the cap (1) is threaded onto a threaded portion of the connector (3).

12. The fillable closure device with triggering pushbutton according to claim 1, wherein the separate container (2) is filled separately.

* * * * *